US008684855B2

(12) United States Patent
Osterman et al.

(10) Patent No.: US 8,684,855 B2
(45) Date of Patent: Apr. 1, 2014

(54) ARTICULATED WATERSLIDE

(75) Inventors: Ross Alan Osterman, Winter Park, FL (US); Justin Michael Schwartz, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 162 days.

(21) Appl. No.: 13/083,297

(22) Filed: Apr. 8, 2011

(65) Prior Publication Data

US 2012/0258812 A1 Oct. 11, 2012

(51) Int. Cl.
*A63G 21/18* (2006.01)
*A63G 21/00* (2006.01)

(52) U.S. Cl.
USPC ..... 472/117; 472/128

(58) Field of Classification Search
USPC ..... 472/59–61, 116, 117, 128; 104/53, 69, 104/70
See application file for complete search history.

(56) References Cited

U.S. PATENT DOCUMENTS

| | | | | |
|---|---|---|---|---|
| 3,830,161 | A | 8/1974 | Bacon | |
| 4,423,864 | A * | 1/1984 | Wiik | 472/91 |
| 5,219,315 | A * | 6/1993 | Fuller et al. | 472/59 |
| 5,230,662 | A | 7/1993 | Langford | |
| 5,704,294 | A * | 1/1998 | Van Winkle et al. | 104/73 |
| 5,735,748 | A | 4/1998 | Meyers et al. | |
| 6,019,547 | A * | 2/2000 | Hill | 405/79 |
| 6,508,717 | B2 * | 1/2003 | Katayama | 472/90 |
| 2012/0129617 | A1 | 5/2012 | Olive et al. | |

FOREIGN PATENT DOCUMENTS

| | | |
|---|---|---|
| CN | 2226963 | 5/1996 |
| NL | 9301619 | 10/1994 |

OTHER PUBLICATIONS

PCT/US2012/031278; International Search Report and the Written Opinion, mailed Jun. 29, 2012, 12 pages.

* cited by examiner

*Primary Examiner* — Kien Nguyen
(74) *Attorney, Agent, or Firm* — Fletcher Yoder, P.C.

(57) ABSTRACT

Present embodiments are directed to systems and methods for providing an articulated waterslide. An articulate waterslide is capable of being maneuvered during operation to change flow paths of the waterslide. Specifically, an embodiment includes a waterslide with a chute configured to facilitate water flow along the chute and configured to transport a patron, an adjustable joint positioned along the chute, and an actuator configured to manipulate the adjustable joint such that a flow path of the chute is changeable.

19 Claims, 7 Drawing Sheets

ARTICULATED WATERSLIDE

FIELD OF DISCLOSURE

The present disclosure relates generally to the field of amusement parks. More specifically, embodiments of the present disclosure relate to methods and equipment utilized to provide an articulated waterslide.

BACKGROUND

Water parks have grown in popularity throughout the world in recent years. A water park is a type of amusement park that incorporates water features and rides, such as waterslides, spray areas, lazy rivers, swimming pools, wave pools, and other recreational bathing and swimming environments. Waterslides are often primary attractions in a water park. Typical waterslides are made of fiberglass troughs and/or tubes that are aligned and coupled together to provide a fixed and generally downward slopping flow path. Water slides (e.g., body slides, inner tube slides, raft slides) may be designed for patrons to ride without a transport device or with a transport device (e.g., on an inner tube or raft). In operation, water is typically pumped to the top of the traditional waterslides and into associated troughs and/or tubes such that the water passes along the flow path. Patrons may then enter the top of the slide and be propelled along with the water from the top of the slide to the bottom of the slide. Gravity and/or pumps generally create the motive force to bring the water (and any patrons riding the slide) to the bottom of the slide. Additional water may be injected along the path to alter the rider/ride vehicle velocity or trajectory.

Certain characteristics of waterslides may make them more or less appealing to patrons. For example, certain patrons may prefer high thrill level waterslides while other patrons may prefer low thrill level waterslides. An extremely steep waterslide that provides rapid acceleration and sharp turns may be considered to have a high thrill level, while a more gradually sloping and winding waterslide that provides less acceleration may be considered to have a low thrill level. Accordingly, in order to appeal to a wide demographic of patrons, many water parks include multiple waterslides that each has characteristics such that each waterslide provides a different thrill level. Indeed, certain water park attractions may include multiple waterslides in the same themed area, wherein each of the separate waterslides has a different associated thrill level. This allows patrons to select a waterslide with a preferred thrill level for riding in the same themed area, which makes the themed area appealing to a wider variety of patrons.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure relates generally to systems and methods for providing a waterslide (e.g., a body slide, an inner tube slide, a raft slide) that is flexible or articulated at one or more locations such that features of the waterslide can be maneuvered into different arrangements to provide a variety of flow paths. A waterslide in accordance with present embodiments may be manipulated or actuated at certain adjustable locations such that components of the waterslide rotate, flex, swivel, or otherwise move with respect to one another in vertical, horizontal, rotational, or combinations of directions. Indeed, present embodiments may include actuators configured to be actuated in one or more motion axes to dynamically create an alternating or moving waterslide system. Movements may be performed at variable speeds, which provide variable transition times based on system design. Actuation of a waterslide in accordance with present embodiments may be initiated by numerous actuation devices, including electric motors, hydraulic or pneumatic cylinders, pneumatic muscles, etc. The coupling of the actuators to other features of the waterslide (e.g., a chute or adjustable joint) may be direct or through a linkage to create mechanical advantage. Actuation may also be created by rotating a motor to run a crank or gear set to move slide components. Cylinders or other exposed equipment associated with actuators may be hidden or thematically decorated to eliminate unsightliness. Further, protective barriers or shrouds may be employed where desirable to prevent access to unauthorized personnel.

Specifically, present embodiments may include waterslide features configured to actuate joints on a single waterslide such that components of the waterslide can be arranged to provide a variety of flow paths. In some embodiments, the variety of flow paths may include flow paths with different thrill levels. For example, a waterslide may be adjusted to provide different incline and/or curve characteristics to achieved different thrill levels. Thus, different groups of patrons that desire different thrill levels can be accommodated by the same waterslide. Further, adjustable waterslides in accordance with present embodiments may be configured to provide multiple unique experiences such that patrons will be encouraged to visit the same attraction multiple times to experience different configurations of the same waterslide.

This is achieved, in accordance with present embodiments, without having to build multiple different waterslides. Accordingly, present embodiments conserve space, limit building costs, and limit operational costs relative to traditional techniques. Further, present embodiments may provide an interesting visual feature for the observation of patrons waiting in line or elsewhere in the water park. Indeed, movement of a waterslide into different configurations, in accordance with present techniques, may provide an atmosphere of excitement.

Figure 1:
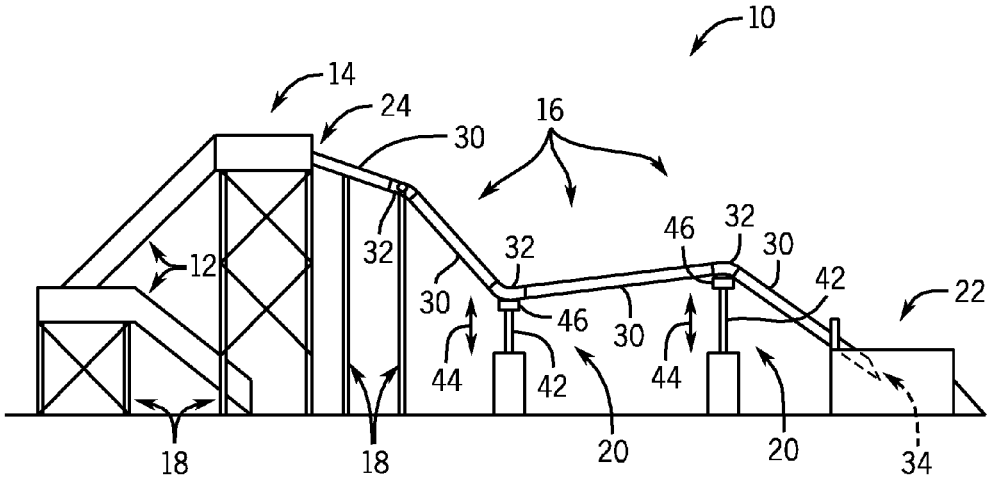
FIG. 1 is a side view of an articulated waterslide in accordance with present techniques.
Figure 2:
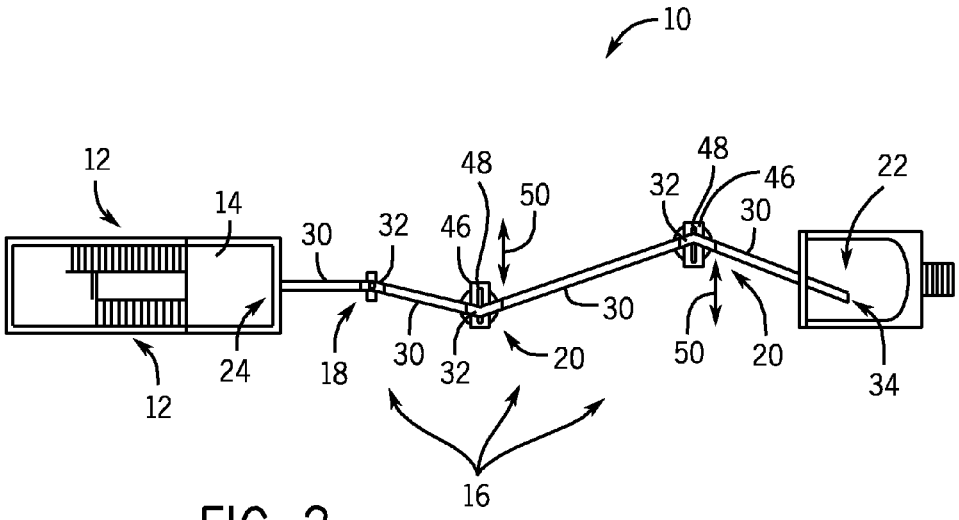
FIG. 2 is an overhead view of the articulated waterslide of FIG. 1 in accordance with present techniques.

Turning to the figures, FIGS. 1 and 2 respectively include a side view and an overhead view of an articulated waterslide 10 in accordance with present embodiments. The waterslide 10 includes a stairway 12, a launch platform 14, a slide 16, fixed supports 18, actuators 20, and a landing area 22. The stairway 12 provides a pathway for patrons to access the launch platform 14 and to gain entry to the slide 16 at an entry point 24. In other embodiments, a gradually sloping pathway, an elevator, or the like may be employed instead of or in addition to the stairway 12. The platform 14 may be sized to accommodate a winding line of patrons awaiting entry to the slide 16. The patrons waiting in such a line on the platform 14 or waiting along the stairway 12 may be able to observe the movements of the slide 16 generated by the actuators 20, which may create an atmosphere of excitement among the patrons. While the illustrated embodiment shows the single slide 16, in other embodiments, multiple slides may be included that are arranged to overlap with one another or otherwise interact to create a stronger visual impact of slides moving relative to one another and to provide more ride availability for patrons. Further, in some embodiments, the actuators 20 may be obscured or thematically decorated to hide unsightly portions.

The slide 16 includes several chutes 30 (e.g., runouts, tubes or troughs) and several adjustable joints 32 that combine to provide a flow path for water and patrons from the entry point 24 to an exit point 34 of the slide 16. The chutes 30 may include generally planar segments, such as runouts that are flat and configured to guide patrons to a splashdown area. In some embodiments the water and patrons are impelled down the slide 16 by gravity and/or pressure (e.g., water pump output). Indeed, water may be pumped to the top of the waterslide 10 such that it can flow down the slide 16 into the landing area 22 (e.g., a swimming pool or an inflatable building). The arrangement of the components of the slide 16 (e.g., the chutes 30 and adjustable joints 32) provides the flow path of the water and/or the patron. Portions of the flow path of the slide 16 may be fixed while other portions may be capable of reconfiguration. In the illustrated embodiment, portions of the slide 16 are supported by fixed supports 18 and portions of the slide are supported by actuators 20 that are capable of maneuvering the slide 16 into different configurations. Specifically, in the illustrated embodiment, an initial portion of the slide 16 near the entry point 24, which includes the chute 30 coupled with the entry point 24, is supported by fixed supports 18. The chute 30 supported by the fixed supports 18 is coupled via one of the adjustable joints 32 with the subsequent chute 30 along the flow path, which is supported by one of the actuators 20 that facilitate adjustment of the slide 16. In other embodiments, the entry point 24 and the initial chute 30 may include adjustable features. Further, in some embodiments, central portions of the slide 16 may be fixed.

The flow path provided by the slide 16 can be changed by adjusting the positioning of the chutes 30 about the adjustable joints 32 with the actuators 20, which are coupled to the adjustable joints 32. For example, in the illustrated embodiment, the actuators 32 include vertical actuation mechanisms 42 (e.g., hydraulic or mechanical devices) that move up and down, as illustrated by arrows 44. When the vertical actuation mechanisms 42 move, the adjustable joints 32 move with them and adjust (e.g., flex or extend) to accommodate changes in relative positioning with respect to the attached chutes 30. Such vertical movement of the actuators 20 and the corresponding movement of the adjustable joints 32 may result in changes in the pitch or degree of inclination of certain portions of the slide 16. Thus, the vertical flow path of the slide 16 is changeable based on movement of the actuators 20. Similarly, a horizontal flow path of the slide 16 may be changed by horizontal actuation mechanisms 46 (e.g., hydraulic or mechanical devices) of the actuators 20. For example, in the illustrated embodiment, the horizontal actuation mechanisms 46 include guides 48 and coupling features (not shown) that extend through the guides 48 and couple with the adjustable joints 32 such that the adjustable joints 32 can be maneuvered horizontally along the guides 48, as illustrated by arrows 50. Thus, the yaw of certain portions of the slide 16 can be changed by horizontal movement of the actuators 20. In other embodiments, different mechanisms may be employed to make vertical and horizontal movements. Further, in some embodiments, the slide 16 can be rotated along the axis of the flow path at various points to adjust banking. For example, in order to accommodate a sharp turn, one of the adjustable joints 32 may be rotated to provide a bank. While the illustrated embodiment includes manipulation of the slide 16 via coupling of the actuators 20 to the adjustable joints 32, in other embodiments, the actuators 20 may be coupled with the chutes 30 and/or the adjustable joints 32. Thus, embodiments may be configured to provide adjustments to the flow path of the slide 16 through maneuvering the chutes 30 and/or the adjustable joints 32.

Figure 3:
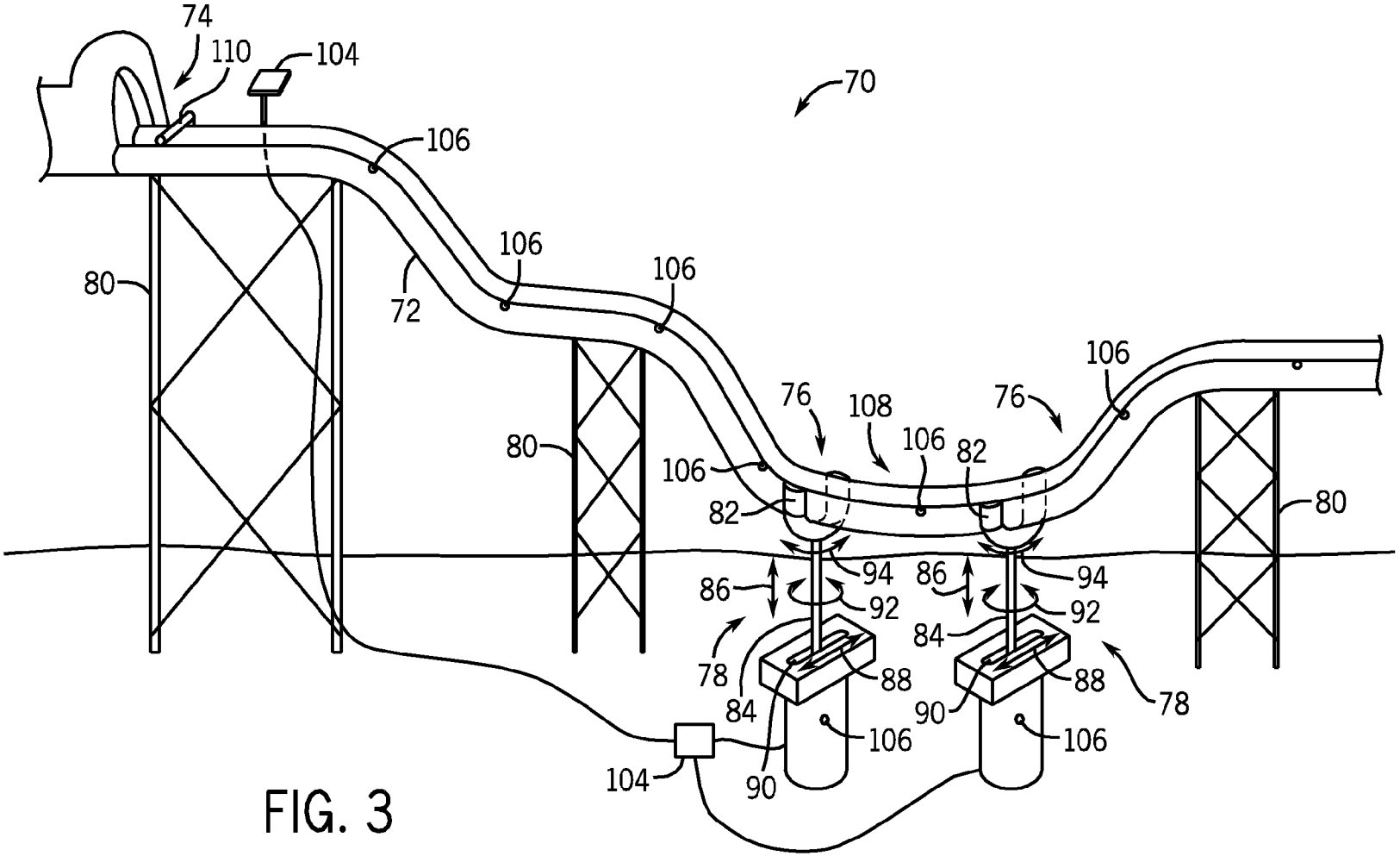
FIG. 3 is a schematic perspective view of an articulate waterslide in accordance with present techniques.

FIG. 3 illustrates an articulated waterslide 70 that includes a chute 72, a chute entry 74, a pair of adjustable joints 76, a pair of actuators 78, and fixed supports 80. The chute 72 may include an expandable and stretchable material (e.g., rubber, plastic) that facilitates manipulation and bending proximate the adjustable joints 76. In some embodiments, the entire chute 72 may be made of the same flexible material. In some embodiments, limited portions of the chute 72 (e.g., portions supported by the fixed supports 80) may include substantially rigid material, while other portions of the chute 72 (e.g., portions proximate or forming the adjustable joints 76) may include flexible material. The actuators 78 are coupled with the chute 72 via clamps 82. The clamps 82 are configured to translate movement of the actuators 78 to the chute 72. For example, slide features 84 of the actuators 78 may move vertically (as illustrated by arrows 86) such that the corresponding portions of the chute 72 move vertically. Similarly, the slide features 84 may move horizontally (as illustrated by arrows 88) along guides 90 such that the corresponding portions of the chute 72 move horizontally. Additionally, the slide features 84 may be rotated about a vertical axis (as illustrated by arrows 92) to adjust angles along the chute 72. Further, the clamps 82 may be rotated about an axis of a flow path of the chute 72 (as illustrated by arrows 94) or tilted in different directions. All of these manipulations of the clamps 82 and the chute 72 may be accommodated by the flexible material forming all or portions of the chute 72. Further, such manipulations enable the same waterslide 70 to be configured to provide different flow paths in accordance with present embodiments. In other embodiments, different types of mechanisms may be utilized to form the chute 72 and the actuators 78 to achieve similar results of changing the flow path provided by a waterslide.

Figure 4:
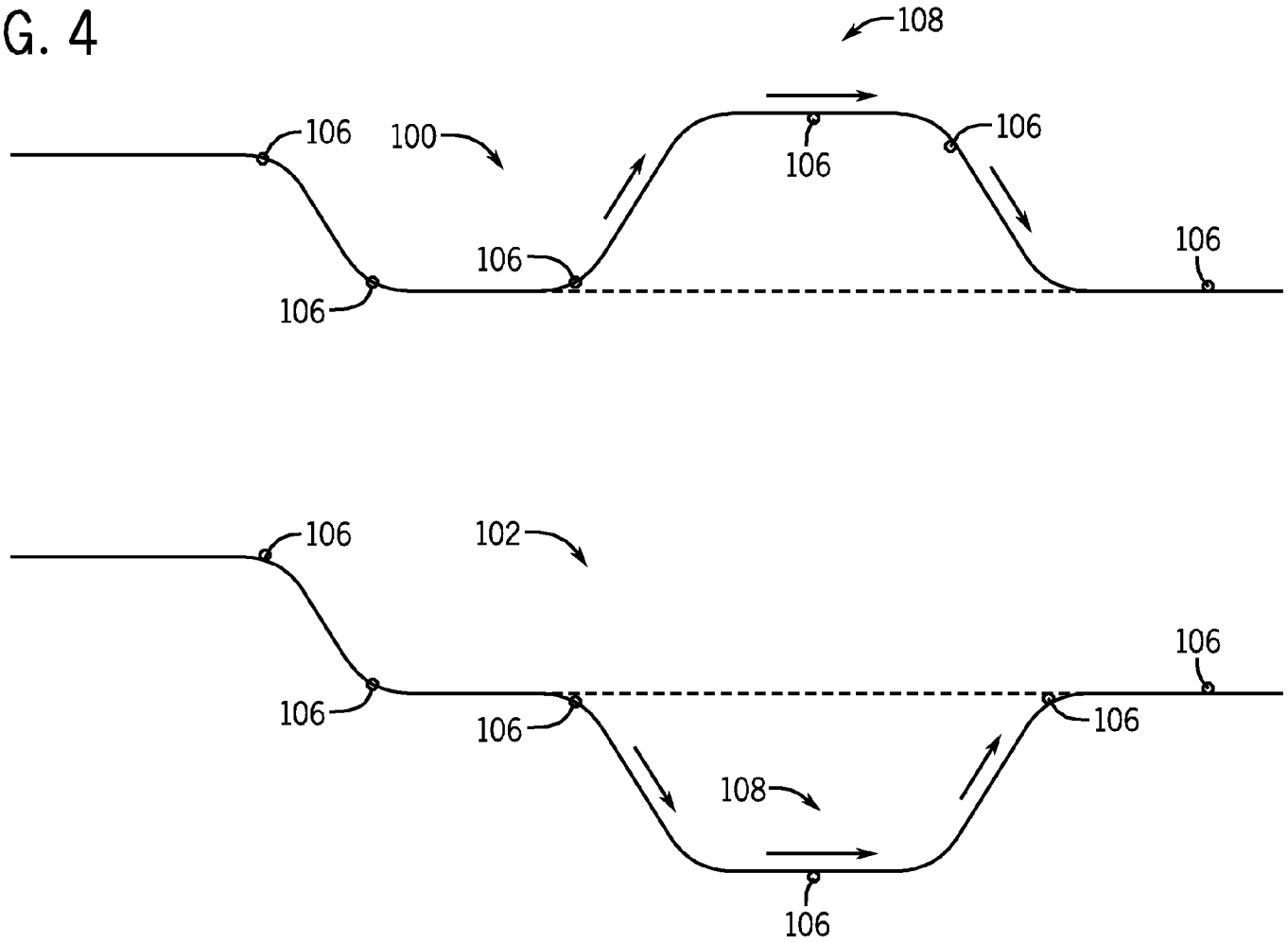
FIG. 4 illustrates two different flow paths for the same waterslide of FIG. 3 in accordance with present techniques.

FIG. 4 illustrates a first flow path 100 and a second flow path 102 for the same waterslide 70 illustrated in FIG. 3 in accordance with present embodiments. The first and second flow paths 100, 102 represent vertical flow paths of the waterslide 70. The waterslide 70 may also have various different horizontal flow paths. These different vertical flow paths 100, 102 of the waterslide 70 demonstrate one example of the functionality of an articulated slide in accordance with present embodiments. Indeed, waterslide components, in accordance with present embodiments, may provide motion with six degrees of freedom to dynamically create a moving waterslide system. The waterslide 70 may initially be arranged to provide the first flow path 100 and then transition to provide the second flow path 102. This may occur via activation of the actuators 78, which correspondingly manipulate aspects of the waterslide 70. In the embodiment illustrated in FIG. 3, the actuators 78 manipulate the chute 72 at the adjustable joints 76, which are formed by the clamps 82 and portions of the chute 72, to provide the different flow paths 100, 102 illustrated in FIG. 4.

In some embodiments, multiple components of a waterslide (e.g., the waterslide 70) may be manipulated or actuated at one time. Thus, different configurations or flow paths can be provided when desired. For example, if a patron wishes to ride the waterslide 70 at a high thrill level, an operator may select a high thrill setting on a control system 104, as illustrated in FIG. 3, that actuates components of the slide to transition from providing the first flow path 100 (low thrill level) to providing the second flow path 102 (high thrill level). Once the waterslide 70 has completely transitioned, the patron may be allowed to enter the slide at the entry point 74. In other embodiments, the slide may transition between providing the first and second flow paths 100, 102 during a time period while the patron is riding the waterslide 70. This may be achieved by activating features of the actuators 78 (e.g., the slide features 84) via the control system 104 when one or more sensors 106 (e.g., through beam sensors, laser sensors, retro-reflective sensors, ultrasonic sensors, vision system sensors) that are configured to communicate (wirelessly or via a cable network) with the control system 104 are triggered, indicating a location of the patron on the waterslide 70. For example, referring to FIG. 4, the waterslide 70 may begin in an arrangement that provides the second flow path 102 and then transition to a configuration that provides the first flow path 100 based on instructions from the control system 104 when a patron is determined to be at a particular location 108 on the waterslide 70 (and along the flow paths 100, 102) by the sensors 106 and the control system 104.

In accordance with present embodiments, a control system (e.g., the control system 104) coordinates with sensors (e.g., sensors 106) wirelessly or via a physical network to control manipulation of a slide (e.g., the waterslide 70) in accordance with present embodiments. For example, as illustrated in FIG. 3, the sensors 106 may be positioned along the chute 72 or other portions of the waterslide 70 such that positioning of slide components (e.g., the actuators 78, the adjustable joints 72) and patrons can be determined and relayed to the control system 104. The control system 104 may include a computer, a programmable logic controller, or a device with a processor and a memory configured to receive inputs from input devices (e.g., the sensors 106) and to provide output to output devices (e.g., actuators, pumps, switches). A memory of the control system 104 may include a non-transitory, computer-readable, medium (e.g., a hard drive) storing code or instructions for activating particular outputs based on particular inputs, including certain failsafe programming. The control system 104 may be configured to initiate all movement of the waterslide 70 (e.g., activation of the actuators 78), confirm that certain movements are completed (e.g., confirm that transitioning of components between different flow path arrangements has completed and components have reached proper locations), and to determine the location of patrons along the waterslide 70. As one example of control system operation, the control system 104 may deactivate a blocking mechanism 110 such that it remains in a default position that prevents use of the waterslide 70 during certain transition periods.

Figure 5:
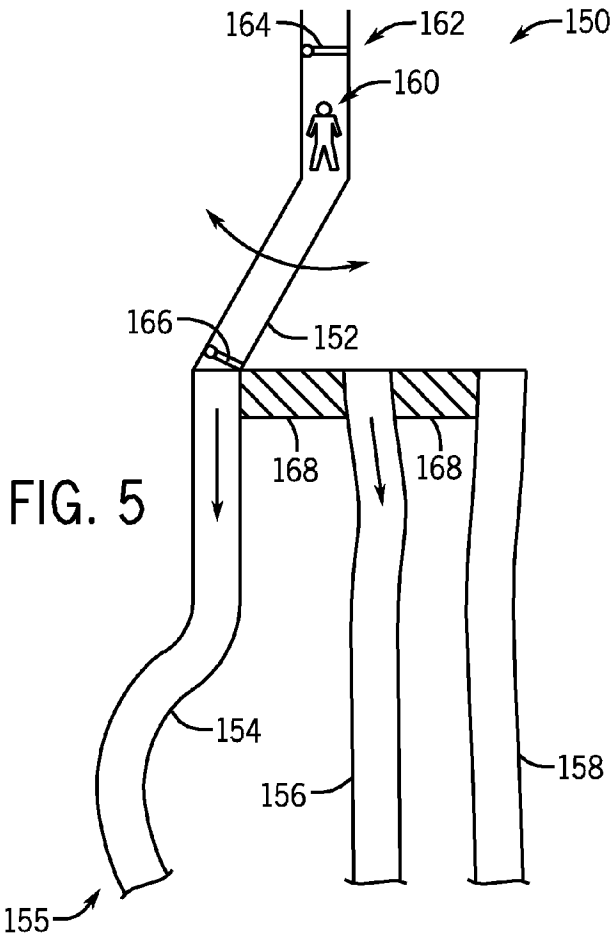
FIG. 5 is a schematic plan view of a waterslide with an oscillating flume and three receiving slides in accordance with present techniques.

FIG. 5 includes a schematic plan view of a waterslide 150 with a swinging flume 152 and first, second, and third fixed receiver slides 154, 156, 158 in accordance with present embodiments. As illustrated in FIG. 5, a patron 160 may enter the flume 152 at an entry point 162 and travel along the flume 152 to one of the three receiver slides 154, 156, 158, depending on the configuration in which the waterslide 150 is arranged. Thus, the waterslide 150 is capable of providing three complete and different flow paths. In the illustrated embodiment, the flume 152 is aligned with the first receiver slide 154 such that the flow path provided by the waterslide 150 includes a path over the first receiver slide 154 to an exit point 155. However, the flume 152 may be actuated to align with the other receiver slides 156, 158 in different orientations of the waterslide 150. Indeed, the flume 152 may be transitioned from a coupling with the first receiver slide 154 (as illustrated in FIG. 5) to coupling with either the second receiver slide 156 or the third receiver slide 158. During transition between coupling the flume 152 with the receiver slides 154, 156, 158, a blocking device 164 may be positioned to resist access to the entry point 162. Further, an exit blocking device 166 may default into position to prevent exit from the flume 152 during such movement. Additionally, soft barriers 168 may be positioned to block access to certain areas and/or to retain the positioning of the exit blocking device 166 during transition of the flume 152 between receiver slides 154, 156, 158.

Figure 6:
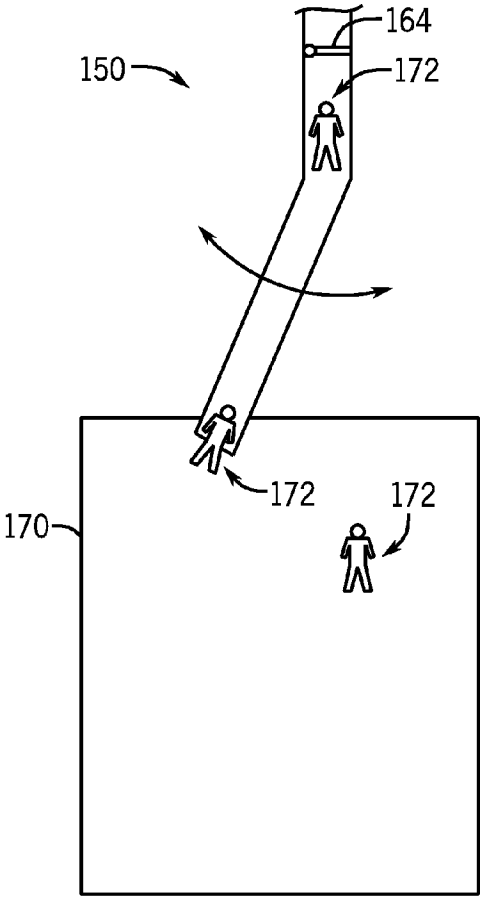
FIG. 6 is a schematic plan view of a waterslide with an oscillating flume and a single, broad, receiving slide in accordance with present techniques.

In one embodiment, as illustrated in FIG. 6, the waterslide 150 includes a single receiver slide 170 that is large enough to accommodate multiple entry points along a path the flume 152 traverses when actuated. In FIG. 6, the flume 152 is configured to swing between positions such that patrons or riders 172 are deposited onto the larger receiving slide 170 at various locations on the receiving slide 170. Further, in similar embodiments, the flume 152 may be manipulated to vary an entry angle and/or height of expulsion into a splashdown area (e.g., a pool). These different configurations may be controlled by a control system (e.g., the control system 104) based on thrill level selections of the patrons or based on random selections by the control system 104.

Figure 7:
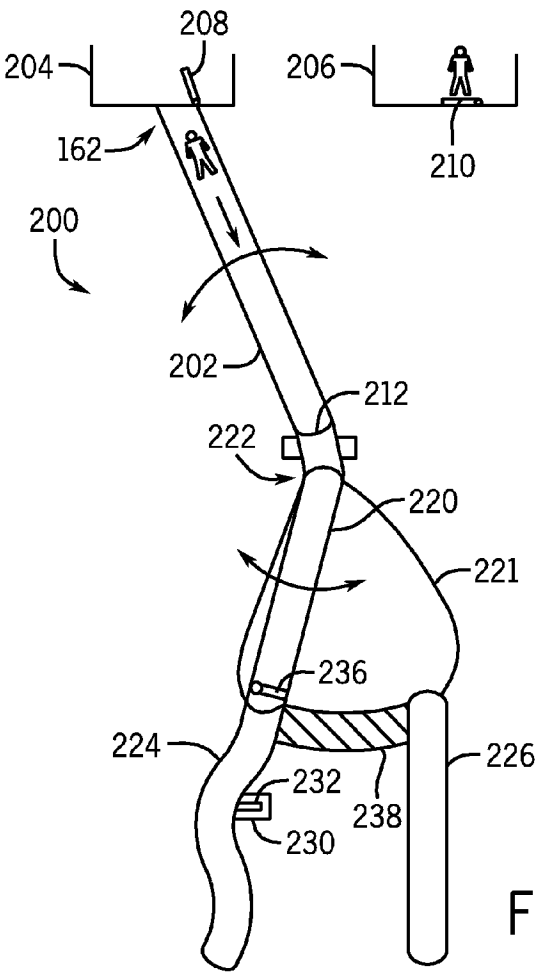
FIG. 7 is a schematic plan view of a waterslide with a flume configured to oscillate an entry point of the flume between platforms and adjustable slide components in accordance with present techniques.

Additionally, in another embodiment, as illustrated by FIG. 7, a waterslide 200 may include a flume 202 configured to swing such that an entry point 162 of the flume 202 changes positioning between a first platform 204 and a second platform 206. The first and second platforms 204, 206 each include a respective entry blocking device 208, 210 that prevents a patron from exiting the associated platform 204, 206 toward the flume 202 until the flume 202 is properly aligned for entry from the associated platform 204, 206. Also, as illustrated in FIG. 7, the flume 202, which generally oscillates about an exit point 212 of the flume 202, may be coupled with another flume 220 that generally oscillates about an entry point 222 of the flume 220. The flume 220 is illustrated as oscillating within a larger slide 221 that receives overflow. Further, the flume 220 exits into either a first receiver slide 224 or a second receiver slide 226, depending on the configuration of the flume 220. In the illustrated arrangement of the waterslide 200, the flume is arranged such that it couples with the first receiver slide 224 and such that the flow path provided by the waterslide traverses the first receiver slide 224. It should be noted that the first receiver slide 224 also includes maneuverable components. Specifically, the first receiver slide 224 includes an actuator 230 that is configured to horizontally reposition a central portion of the first receiver slide 224 by moving it along a groove 232. The second receiver slide 226 is fixed. An exit of the flume 220 may be blocked by a blocking device 236 during transitioning between coupling the flume 220 with the first and second receiver slides 224, 226. Additionally, a soft barrier 238 (e.g., a foam wall) may prevent a patron from exiting the flume 220 during a transition time.

Figure 8:
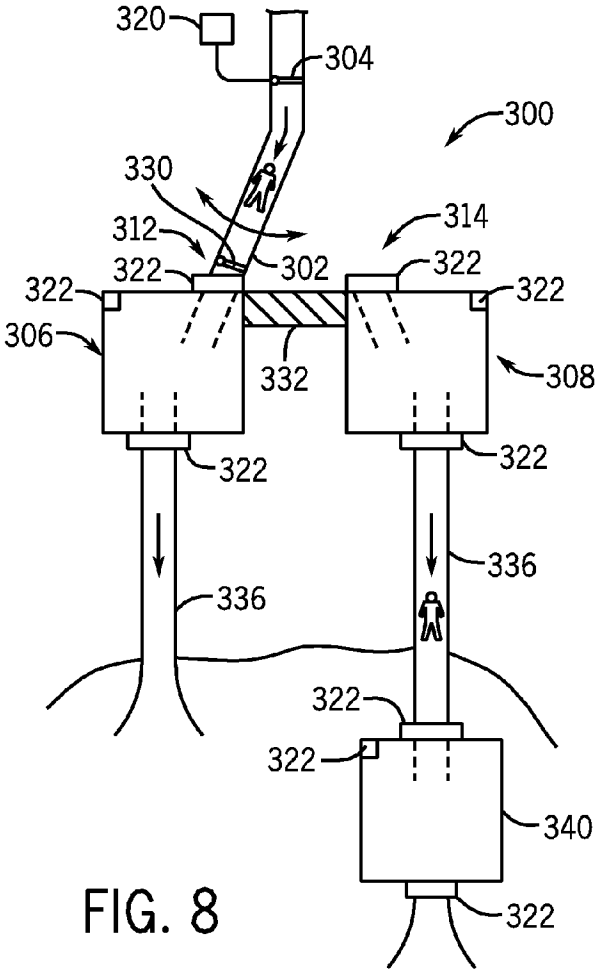
FIG. 8 is a schematic plan view of a waterslide with an oscillating flume configured to direct a flow path through flexible containment structures in accordance with present techniques.

In yet another embodiment, as illustrated in FIG. 8, a waterslide 300 may include an oscillating flume 302 with a blocking device 304 that prevents entry into the flume 302 under certain conditions. For example, the flume 302 may be configured to direct a flow path through a first containment structure 306 or a second containment structure 308 (e.g., inflatable structures typically referred to as "bounce houses"), and the blocking device 304 may block access to entering the flume 302 when the flume 302 is not aligned with respective entry points 312, 314 to either of the first or second structures 306, 308, or when a patron remains in one of the first or second structures 306, 308. Specifically, for example, a control and monitoring system 320 may receive data from sensors 322 (e.g., motion sensors, positional sensors) that detect proper alignment of the flume 302 with the entry points 312, 314 and/or whether a patron has entered, exited, or remains within the structures 306, 308. Thus, if a patron is in the first structure 306 when the flume 302 is aligned with the entry point 312, the control system 320 may default the blocking device 304 to a closed position to prevent additional patrons from entering the first structure 306. When the flume 302 is transitioning between alignment with the first and second structures 306, 308, an exit blocking device 330 may block patrons from exiting the flume 302 along with a soft barrier 332 (e.g., a foam wall). Additionally, it should be noted that the waterslide 300 includes additional flumes 336 that exit to a splashdown 338 or other structures 340 (e.g., an inflatable or foam structure).

Figure 9:
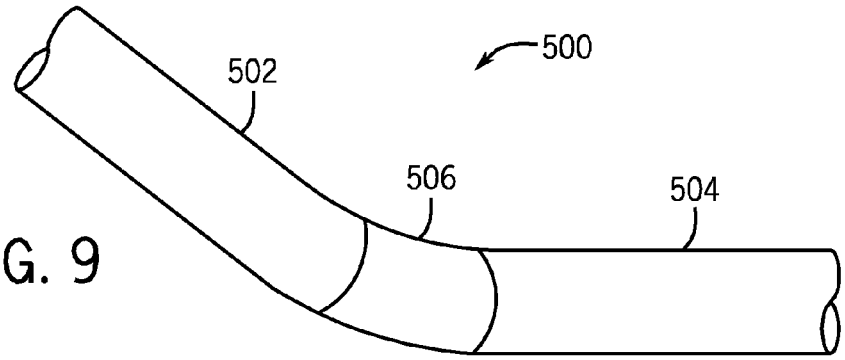
FIG. 9 is a perspective view of an adjustable joint of a waterslide in accordance with present techniques.

FIG. 9 is a perspective view of various components of a waterslide 500, including a first chute 502 coupled with a second chute 504 via an adjustable joint 506 in accordance with present embodiments. In the illustrated embodiment, the first chute 502, the second chute 504, and the joint 506 are tubular. However, in other embodiments these components of the waterslide may be trough-shaped, substantially planar, or some combination of shapes that facilitate flow of water and transport of a patron. For example, in accordance with one embodiment, the first and second chutes 502, 504 may be tubular and the joint 506 may be trough-shaped. The adjustable joint 506 includes smooth, flexible and stretchable material (e.g., rubber) that is capable of adjusting to accommodate relative positioning changes of the first and second chutes 502, 504. Thus, the adjustable joint 506 flexes and bends to facilitate smooth transition of patrons along the waterslide 500. Further, the adjustable joint stretches and bends to prevent a gap from forming between the first and second chutes 502, 504. In other words, the adjustable joint 506 accommodates position changes to maintain connectivity between the adjustable joint 506 and the chutes 502, 504. In some embodiments, the joint 506 may include a bellows-like configuration or telescoping features to facilitate bending, flexing, and so forth. The first and second chutes 502, 504 may include similar flexible and stretchable material or more rigid material (e.g., fiberglass or fiber reinforced plastic). In some embodiments, certain of the components of the waterslide 500 may include metal support features where desired for additional structural support.

Figure 10:
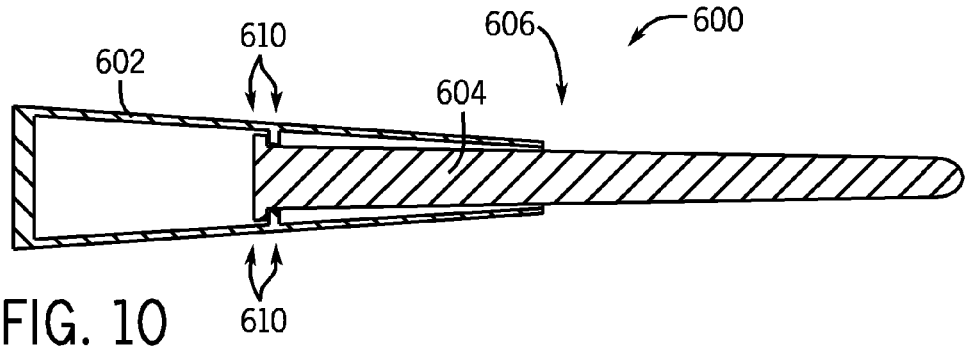
FIG. 10 is a cross-sectional side view of an adjustable joint of a waterslide in accordance with present techniques.
Figure 11:
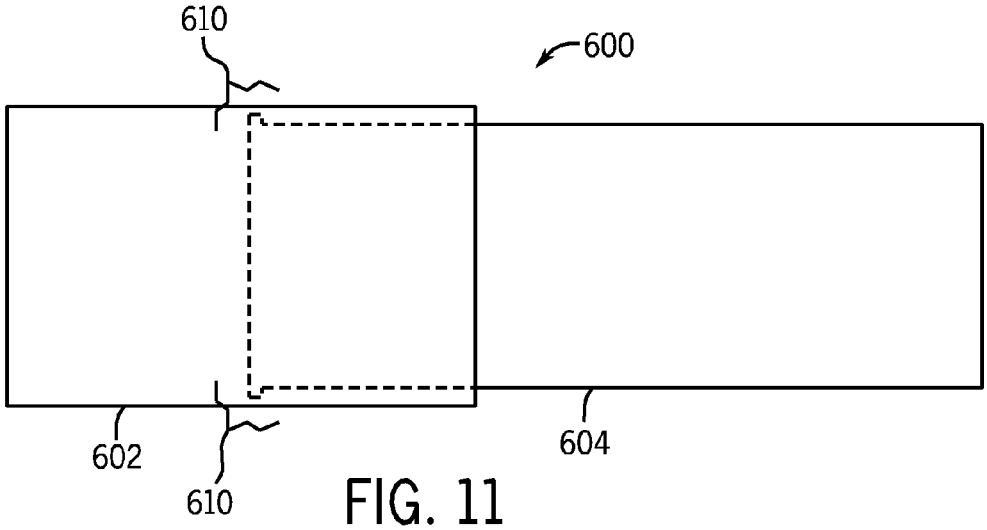
FIG. 11 is an overhead view of the adjustable joint of FIG. 10 in accordance with present techniques.

FIG. 10 is a cross-sectional view of an adjustable joint 600 in accordance with present embodiments, and FIG. 11 is an overhead view of the adjustable joint 600. In the illustrated embodiment, the adjustable joint 600 is generally planar. However, in some embodiments, the adjustable joint may be arranged to form a tubular shape or a trough. The adjustable joint 600 may be utilized to accommodate relative movement of waterslide features. Indeed, for some locations along a waterslide, bending and flexing of waterslide components may create large gaps between the components. For example, a pair of adjacent rigid chutes forming portions of the flow path of a waterslide may be moved relative to one another such that a gap should be formed between an exit of one of the chutes and an entry to the other. In accordance with present embodiments, the adjustable joint 600 may be used between such chutes to provide an extension between such gaps. Indeed, the adjustable joint 600 includes an outer portion 602 and an inner extension 604 that perform a telescoping action to accommodate position changes.

The inner extension 604 is configured to slide out of the outer portion 602 to accommodate relative changes between adjacent waterslide components (e.g., chutes). At a transition location 606 between the outer portion 602 and the inner extension 604, when the inner extension 604 is pulled out, the edges of the outer portion 602 and/or the inner extension 602 are tapered in the illustrated embodiment. This facilitates smooth transition of patrons over these areas. Further, joints such as the adjustable joint 600 may be arranged such that the flow path of the slide is directed from the outer portion 602 toward the extended inner extension 602 to minimize patron discomfort when passing over the adjustable joint 600. Hard stop features 610 may be included within the adjustable joint 600 such that the hard stop features 610 abut one another as the inner extension 604 slides out of the outer portion 602. The hard stop features 610 may be arranged such that when a certain length of the inner extension 604 is pulled out of the outer portion 602, the inner extension 604 is prevented from sliding further and over extending. The components of the adjustable joint 600 may be formed from various materials. For example, the outer portion 602 may include a low friction bearing material (e.g., ultra-high-molecular-weight polyethylene) that lines the inner cavity of the outer portion 602 to facilitate sliding the inner extension 604 relative to the outer portion 602. The inner extension 604 may include a strong and flexible material. While the illustrated embodiment includes the outer portion 602 and the inner extension 604 in the adjustable joint 600, in some embodiments, all or some of these features may be components of a chute. Further, in some embodiments, sensors may monitor the positioning of the outer portion 602 and the inner extension 604.

Figure 12:
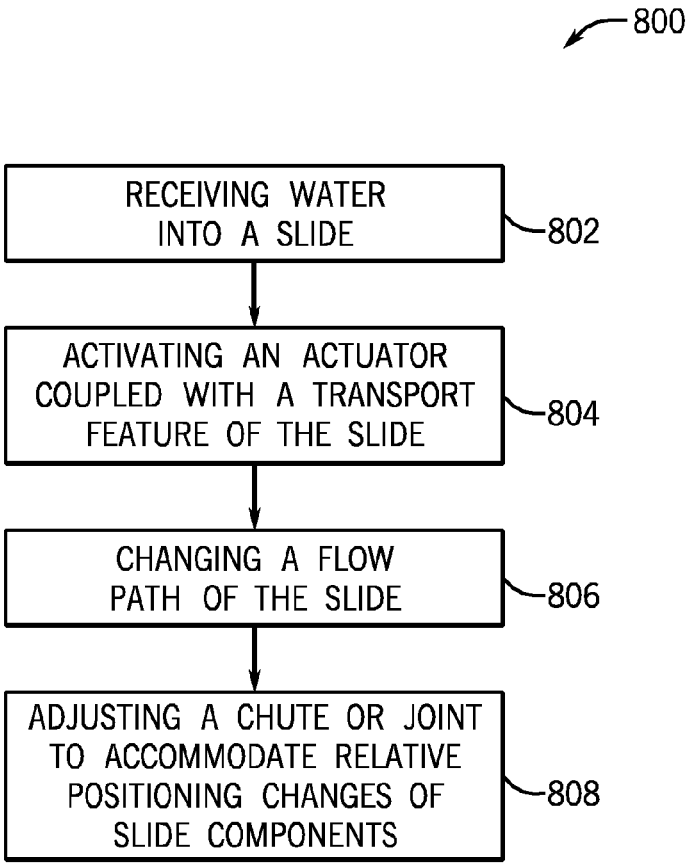
FIG. 12 is a process flow diagram for a method of changing a flow path of a waterslide in accordance with present techniques.

FIG. 12 illustrates a process flow diagram for a method 800 of changing a flow path of a waterslide in accordance with present embodiments. Specifically, the method 800 begins with receiving water into a slide such that the water flows along a flow path of the slide, as represented by block 802. The slide may include transport features, such as a chute (e.g., tubing or troughs) and a joint, configured to facilitate transport of the water and a patron along the flow path of the slide. Block 804 represents activating an actuator coupled with the chute or the joint such that the chute moves about the joint. This results in changing a flow path of the slide, as represented by block 806. In some embodiments, the actuator may be activated during transport of a patron along the slide. Block 808 represents adjusting (e.g., stretching, twisting, flexing, extending) a feature of a joint or chute to accommodate a gap between the chute and the joint formed by the movement of the chute about the joint. The step represented by block 808 may include sliding an extender from within the joint or the chute.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A waterslide, comprising:

a chute configured to facilitate flow of water along the chute and configured to transport a patron with the water to an exit point of the chute;

an adjustable joint positioned along the chute; and an actuator configured to manipulate the adjustable joint such that a flow path of the chute is changeable; and a plurality of receiver slides configured to align with the chute when the flow path of the chute is arranged correspondingly.

2. The waterslide of claim 1, wherein the adjustable joint comprises flexible material of the chute and a coupling feature attached to the actuator.

3. A waterslide, comprising:

a chute configured to facilitate flow of water along the chute and configured to transport a patron with the water to an exit point of the chute;

an adjustable joint positioned along the chute; and an actuator configured to manipulate the adjustable joint such that a flow path of the such that a flow path of the chute is changeable, wherein the actuator comprises a horizontal actuation mechanism configured to move the adjustable joint along a horizontal path.

4. The waterslide of claim 3, wherein the actuator comprises both the horizontal actuation mechanism and a vertical actuation mechanism configured to move the adjustable joint along a vertical path.

5. The waterslide of claim 3, wherein the actuator is configured to provide six degrees of freedom.

6. A waterslide, comprising:

a chute configured to facilitate water flow along the chute and configured to transport a patron;

an adjustable joint positioned along the chute; and an actuator configured to manipulate the adjustable joint such that a flow path of the chute is changeable, wherein the adjustable joint comprises a chute segment, the chute segment housing an extension configured to slide out of the chute segment to accommodate flow path changes.

7. The waterslide of claim 6, wherein the chute comprises a plurality of substantially rigid troughs and/or tubing segments coupled via a plurality of adjustable joints.

8. The waterslide of claim 7, wherein the actuator is coupled with a one of the plurality of substantially rigid troughs or tubing segments.

9. A waterslide, comprising:

a chute configured to facilitate water flow along the chute and configured to transport a patron;

an adjustable joint positioned along the chute;

an actuator configured to manipulate the adjustable joint such that a flow path of the chute is changeable; and a containment structure with flexible walls disposed at a base of the chute and an additional chute exiting the containment structure.

10. The waterslide of claim 9, wherein the containment structure comprises an inflatable structure.

11. A waterslide, comprising:

a slide formed from one or more chute segments and one or more adjustable joints configured to facilitate flow of water along the slide and configured to transport a patron with the water along the slide to an exit point;

wherein the one or more chute segments and the one or more adjustable joints are configured to be arranged to provide a plurality of different flow paths; and one or more actuators configured to manipulate the one or more adjustable joints to arrange the slide to provide each of the plurality of different flow paths, wherein the slide is configured to align a base of the slide with one of a plurality of locations along a top portion of a broad slide depending on which of the plurality of flow paths the slide is arranged to provide.

12. The waterslide of claim 11, wherein the one or more actuators each comprise one or more of a vertical actuation mechanism, a horizontal actuation mechanism, and a rotational actuation mechanism.

13. The waterslide of claim 11, wherein the one or more actuators comprise an actuator that is directly coupled to the one or more chute segments.

14. The waterslide of claim 11, wherein the one or more actuators comprise an actuator that is directly coupled to the one or more adjustable joints.

15. A waterslide, comprising:

a slide formed from one or more chute segments and one or more adjustable joints configured to facilitate flow of water along the slide and configured to transport a patron with the water along the slide to an exit point;

wherein the one or more chute segments and the one or more adjustable joints are configured to be arranged to provide a plurality of different flow paths;

one or more actuators configured to manipulate the one or more adjustable joints to arrange the slide to provide each of the plurality of different flow paths; and a plurality of receiver slides, wherein each of the plurality of receiver slides is configured to align with the slide when the slide is arranged to provide a corresponding one of the plurality of flow paths.

16. A waterslide, comprising:

a slide formed from one or more chute segments and one or more adjustable joints configured to facilitate water flow along the slide and configured to transport a patron along the slide;

wherein the one or more chute segments and the one or more adjustable joints are configured to be arranged to provide a plurality of different flow paths;

one or more actuators configured to manipulate the one or more adjustable joints to arrange the slide to provide each of the plurality of different flow paths, wherein the slide is configured to align an entry of the slide with one of a plurality of waiting locations depending on which of the plurality of flow paths the slide is arranged to provide.

17. A method of changing a flow path of a waterslide, comprising:

receiving water into a slide at an entry point such that the water flows along a flow path of the slide, wherein the slide comprises a chute and a joint configured to facilitate transport of the water and a patron to an exit point;

activating an actuator coupled with the chute or the joint such that the chute moves about the joint and changes the flow path; and adjusting a feature of the chute or joint based on the movement of the chute about the joint to maintain connectivity between the chute and the joint, wherein adjusting the feature comprises sliding an extender from within the joint or the chute to accommodate a gap between the chute and the joint formed by the movement of the chute about the joint.

18. The method of claim 17, comprising activating the actuator during transport of the patron.

19. A method, comprising;

receiving water into a slide at an entry point such that the water flows along a flow path of the slide, wherein the slide comprises a chute and a joint configured to facilitate transport of the water and a patron to an exit point;

activating an actuator coupled with the chute or the joint such that the chute moves about the joint and changes the flow path;

adjusting a feature of the chute or joint based on the movement of the chute about the joint to maintain connectivity between the chute and the joint; and monitoring a containment structure with walls formed of flexible material disposed along the flow path with a control and monitoring system to determine whether the patron is within the containment structure.

* * * * *